US007229314B2

(12) United States Patent
Nakamura et al.

(10) Patent No.: US 7,229,314 B2
(45) Date of Patent: Jun. 12, 2007

(54) TERMINAL FITTING

(75) Inventors: Keiichi Nakamura, Yokkaichi (JP); Yutaka Noro, Yokkaichi (JP); Hajime Kawase, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/345,019

(22) Filed: Feb. 1, 2006

(65) Prior Publication Data

US 2006/0172598 A1 Aug. 3, 2006

(30) Foreign Application Priority Data

Feb. 2, 2005 (JP) ..... 2005-026666

(51) Int. Cl.
*H01R 13/40* (2006.01)

(52) U.S. Cl. ..... 439/595

(58) Field of Classification Search ..... 439/595, 439/884, 877, 746, 747, 839, 872
See application file for complete search history.

(56) References Cited

U.S. PATENT DOCUMENTS 6,244,900 B1 6/2001 Ishikawa et al.
6,551,151 B2 * 4/2003 Suzuki ..... 439/877
6,755,696 B1 * 6/2004 Ko ..... 439/746
2003/0157832 A1 * 8/2003 Tabata ..... 439/587
2003/0157833 A1 8/2003 Tsuji et al.

FOREIGN PATENT DOCUMENTS

EP 1 303 008 A2 4/2003

* cited by examiner

*Primary Examiner*—Alexander Gilman
(74) *Attorney, Agent, or Firm*—Gerald E. Hespos; Anthony J. Casella

(57) ABSTRACT

A male terminal fitting (1) has a rectangular tube (4). A locking edge (15) engageable with a locking portion provided in a cavity is formed over the entire width in an outer surface of a rectangular tube (4). No opening is formed in the outer surface of the rectangular tube portion (4) by forming this locking edge (15). Closing pieces (12) are provided at positions slightly retracted inwardly of the locking edge (15). Thus, problems such as the intrusion of external matter from the outside and the deformation of a leading end portion of another male terminal fitting (1) due to the entrance into the rectangular tube (4) can be avoided.

8 Claims, 10 Drawing Sheets

TERMINAL FITTING

BACKGROUND OF THE INVENTION

1. Field of the Invention

The invention relates to a terminal fitting.

2. Description of the Related Art

U.S. Pat. No. 6,244,900 discloses a male terminal fitting with a rectangular tubular main portion. A locking hole is formed in the upper surface of main portion and is retained by the engagement of a projecting lock with the locking hole. Two stabilizers project from upper edges of side surfaces at the opposite sides of the locking hole to prevent an erroneous insertion of the male terminal fitting into a cavity, such as an upside-down insertion.

The stabilizers are, in many cases, formed by making cuts in the main portion and bending the cut portions. A through hole left by forming the stabilizers is used as part of the locking hole. Male terminal fittings frequently are handled in large numbers prior to use. As a result, the leading end of one male terminal fitting can intrude into the locking hole of another male terminal fitting. External matter also can intrude through the locking hole and into the main portion. These intrusions can deform the male terminal fittings.

The present invention was developed in view of these problems and an object thereof is to prevent or reduce the likeliness of the intrusion of an external matter into a locking hole.

SUMMARY OF THE INVENTION

The invention relates to a terminal fitting that can be inserted into a cavity of a connector housing. The terminal fitting has a tube with a plurality of side walls. A locking edge is formed in at least one of the side walls of the tube and is engageable with a lock in the cavity. The locking edge is formed by making at least one cut in one side wall. At least one closing piece is formed on at least one of adjacent side walls and extends in at an angle to at least partly close an opening formed in the tube at or near the locking edge. The closing piece reduces the likelihood of intrusion of external matter into the opening.

Front and rear cuts preferably are made substantially along a width direction of one side wall and extend beyond the entire width of the cut side wall a specified distance to at least one of the adjacent side walls. Accordingly, the locking edge that is engageable with the lock can be formed over substantially the entire width. Thus, secure engagement with the lock is ensured. Further, intrusion of external matter is prevented since only a reduced opening is formed at a position on the terminal fitting to be engaged with the lock.

An area between the cuts preferably is retracted inwardly of the tube from the side wall to form the closing piece.

The edge of the tube exposed by inwardly retracting the closing piece preferably is at the front with respect to an inserting direction of the terminal fitting into the connector housing and defines the locking edge that is engageable with the lock of the connector housing. Accordingly, the height of the closing piece can be adjusted by adjusting the length of the cuts, and a sufficient engaging depth with the lock is ensured.

Two closing pieces preferably are bent from the substantially opposite adjacent side walls and are substantially opposed to each other. Leading ends of the substantially opposed closing pieces preferably substantially abut against each other. Thus, the lengths of the closing pieces are shorter as compared to a case where only one closing piece is bent from one side wall, and bending strength is higher. Therefore, the closing pieces are unlikely to be deformed by an external force.

The tube preferably is a rectangular tube formed by bending first and second side walls from a base wall to oppose each other and bending a ceiling wall from at least one side wall to substantially oppose the base wall.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
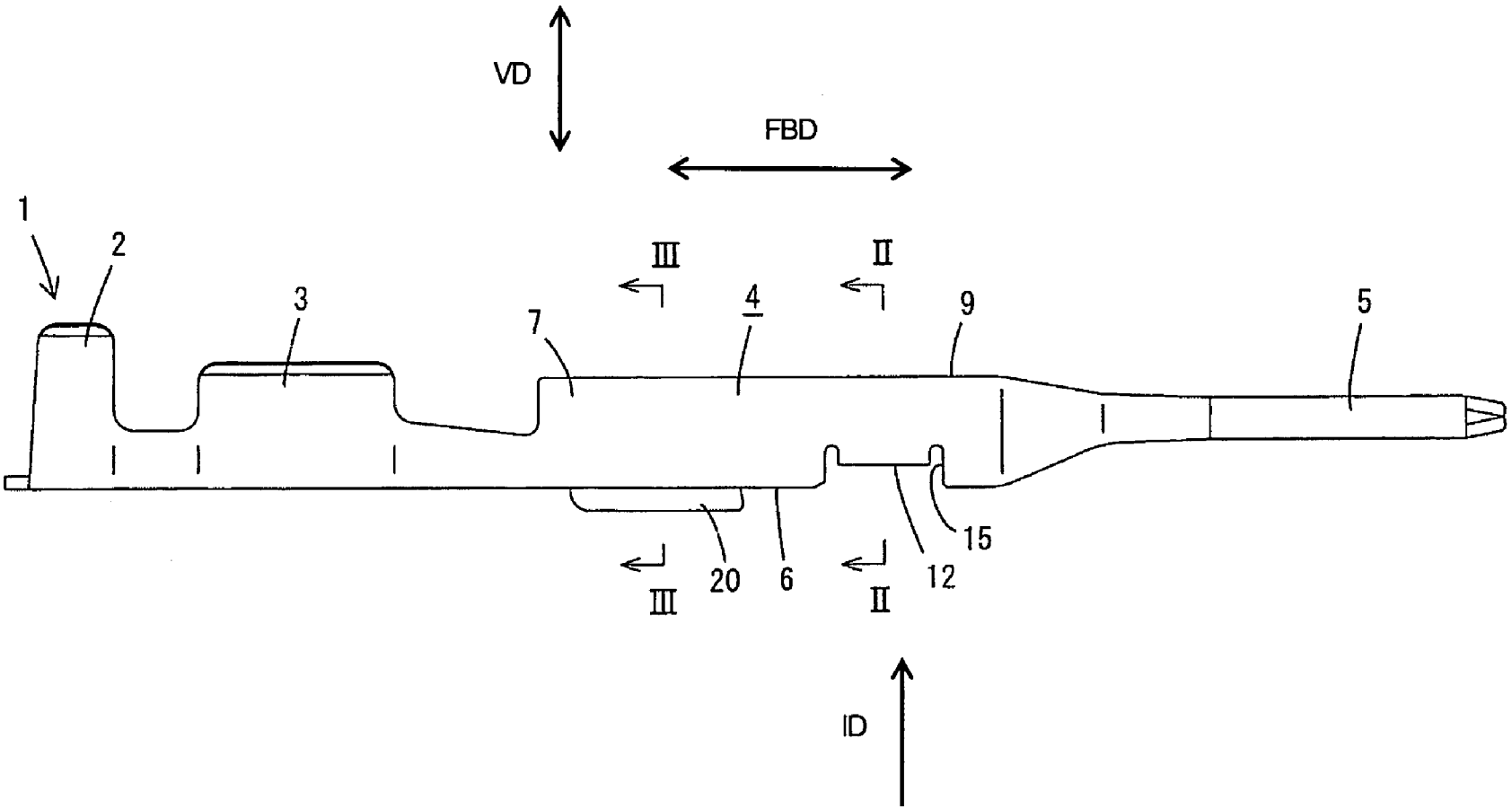
FIG. 1 is a left side view of a male terminal fitting according to one embodiment of the invention.
Figure 2:
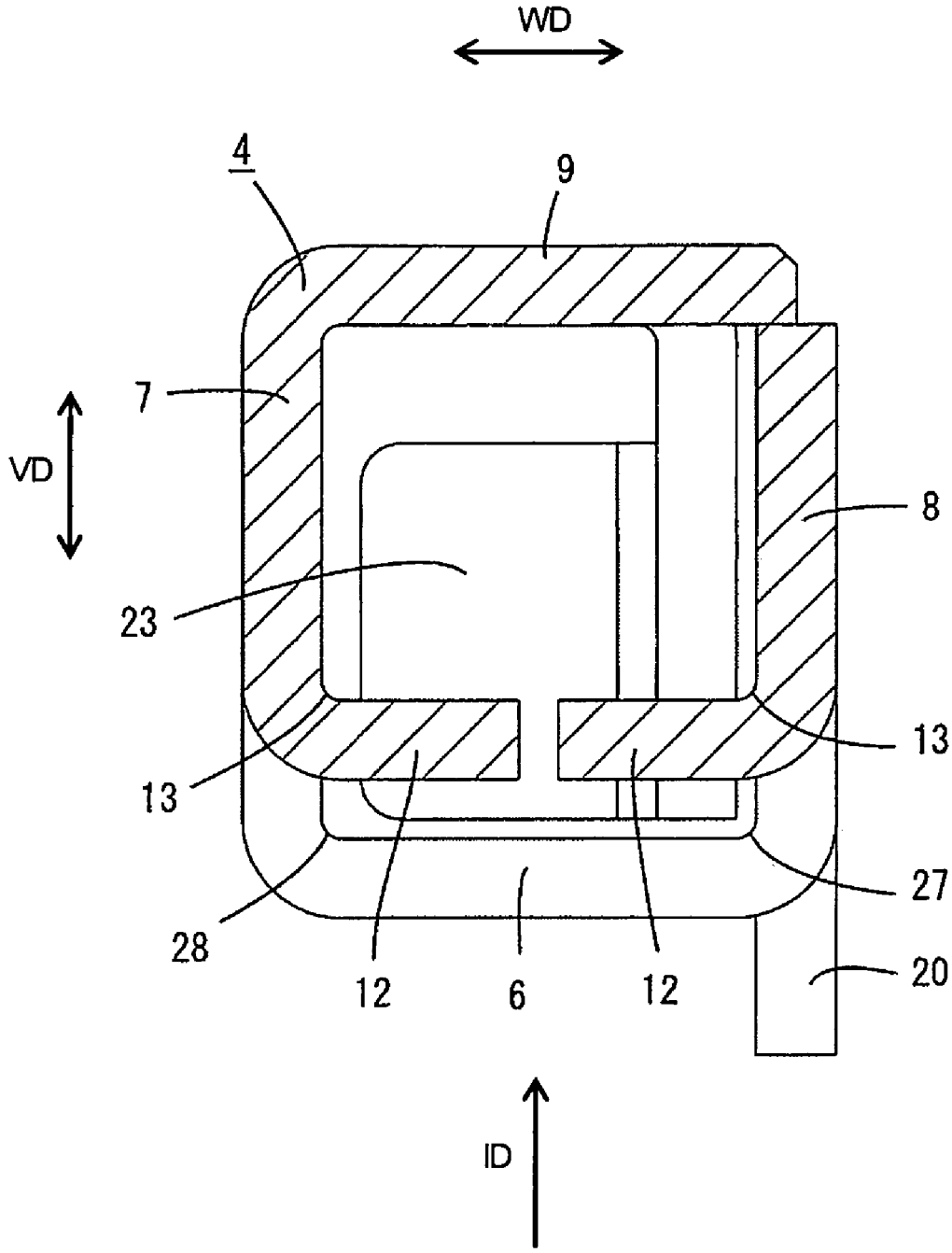
FIG. 2 is a section along II—II of FIG. 1.

A male terminal fitting according to the invention is identified by the numeral 1 in FIGS. 1 to 10. The phrase vertical direction VD is used herein to define the vertical orientation in FIG. 1, while the horizontal orientation in FIG. 1 is referred to herein as the forward and backward directions FBD, with the right side in FIG. 1 being the front. The transverse direction of the terminal fitting 1 is substantially orthogonal to the plane of FIG. 1. The phrase width direction WD is used herein to describe the vertical orientation in FIG. 10.

Figure 10:
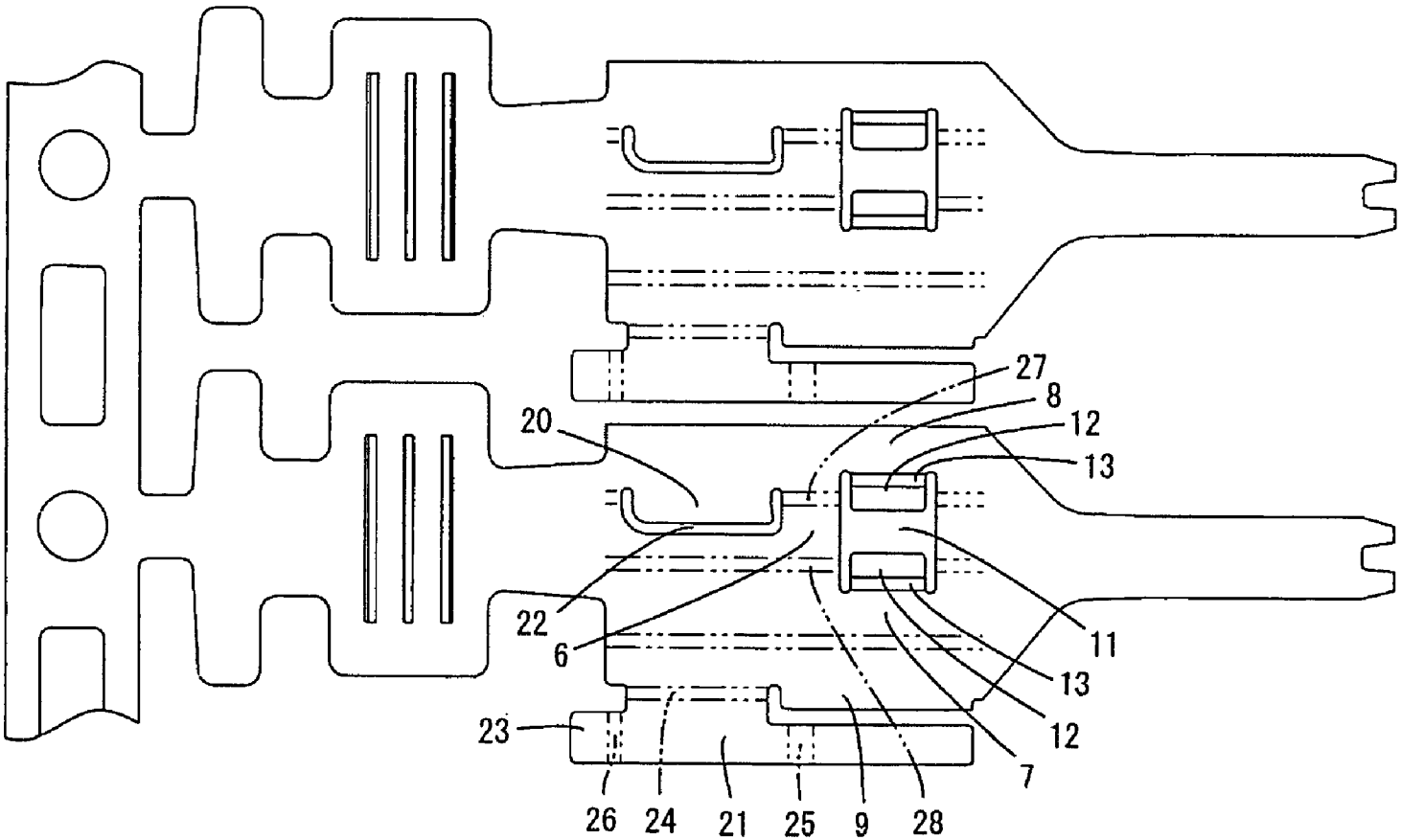
FIG. 10 is a development of the male terminal fitting.

The male terminal fitting 1 is formed by bending an initially flat conductive metallic plate or blank having a development shown in FIG. 10. The male terminal fitting 1 has opposite front and rear ends. An insulation barrel 2 is disposed at the rear end and can be crimped, bent or folded into connection with an insulation coating of a wire W. A wire barrel 3 is forward of the insulation barrel 2 and can be crimped, bent or folded into connection with a conductive core of the wire W exposed from the insulation coating. A rectangular tube 4 is forward of the wire barrel 3 and a terminal contact portion 5 projects forward from the front end of the rectangular tube 4.

Figure 3:
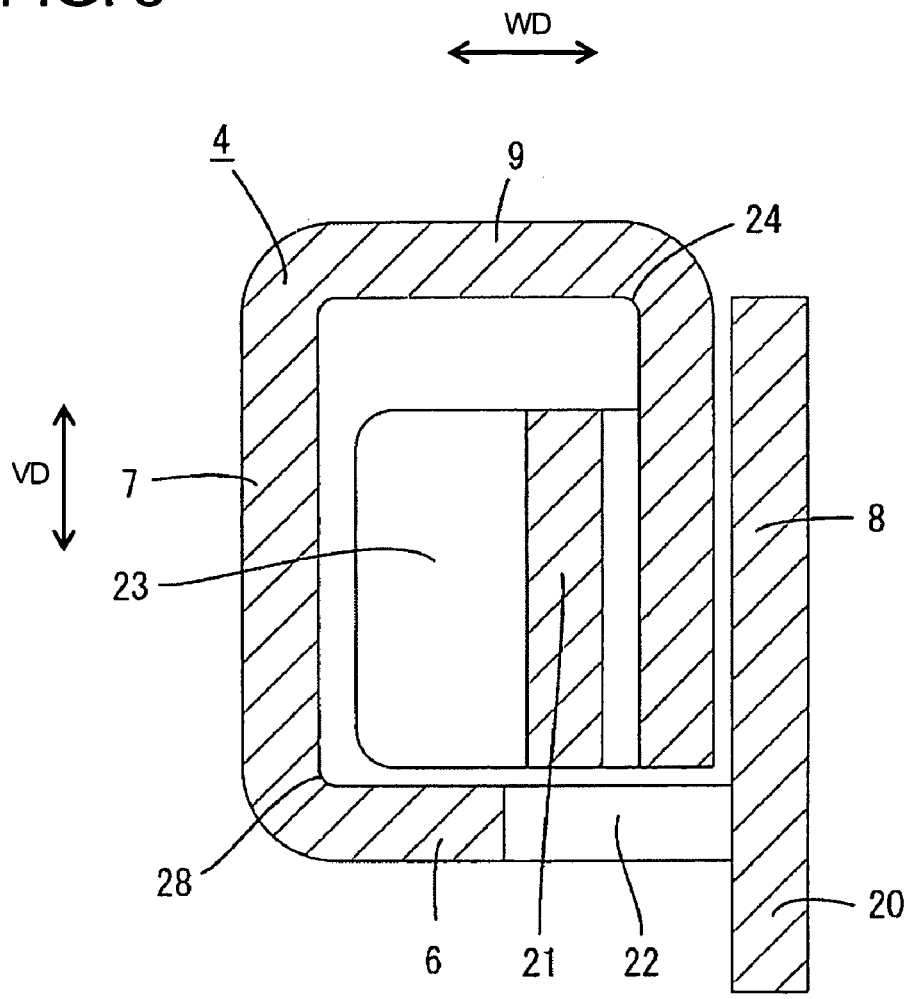
FIG. 3 is a section along III—III of FIG. 1.
Figure 4:
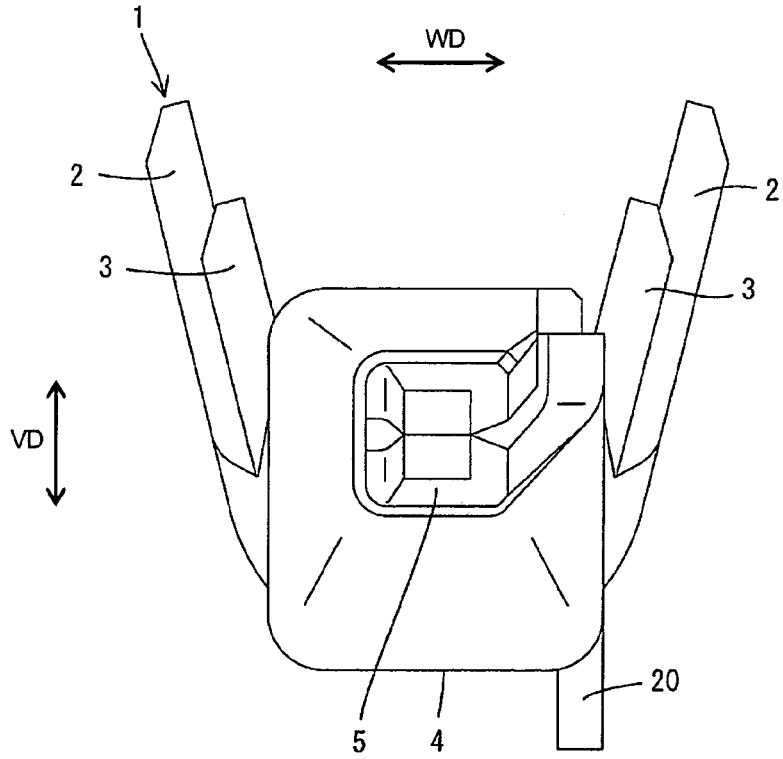
FIG. 4 is a front view of the male terminal fitting.
Figure 5:
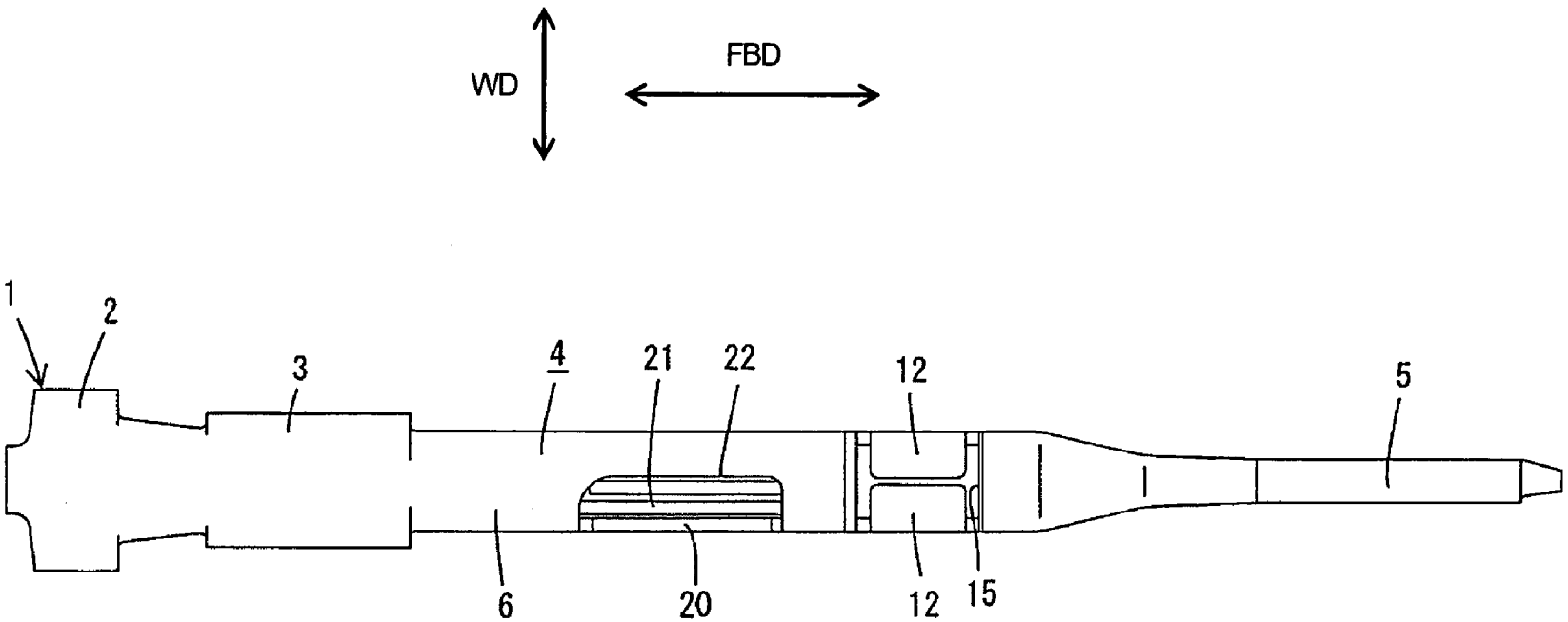
FIG. 5 is a bottom view of the male terminal fitting.
Figure 6:
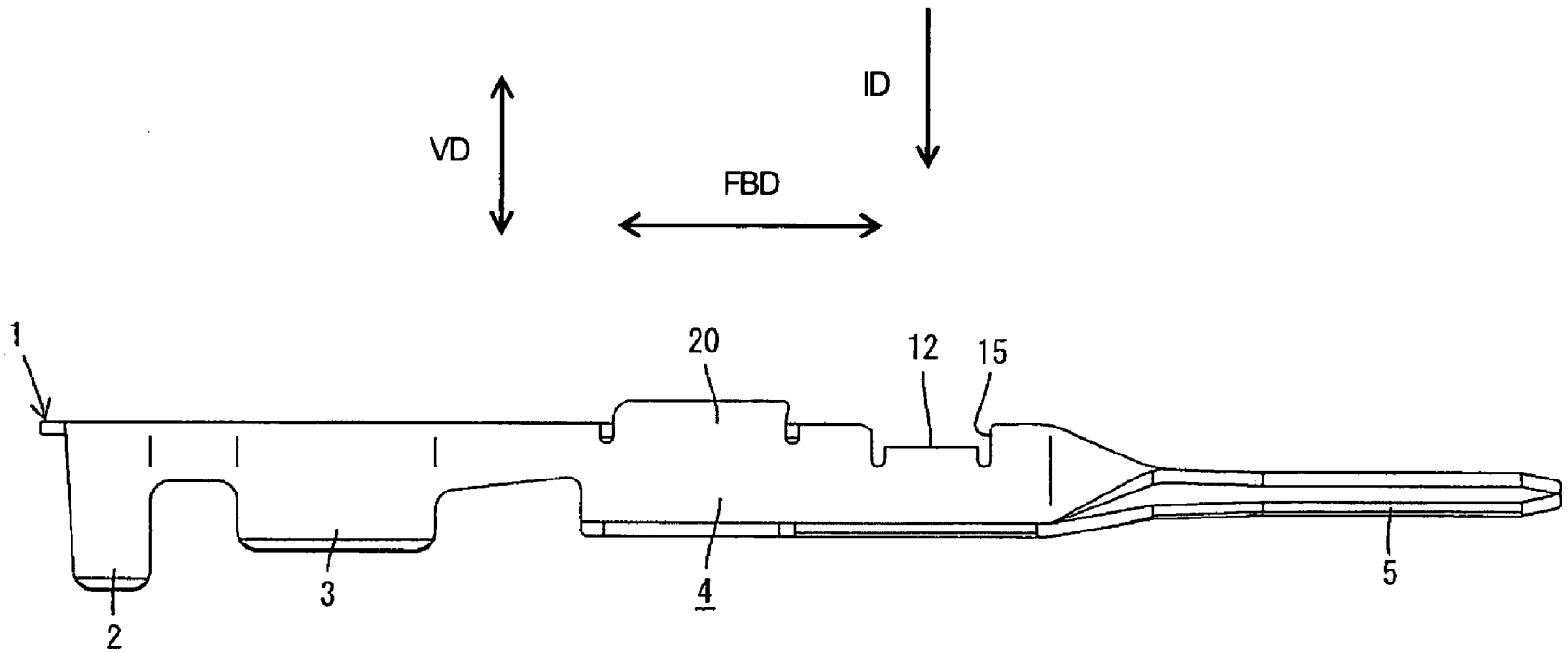
FIG. 6 is a right side view of the male terminal fitting.
Figure 7:
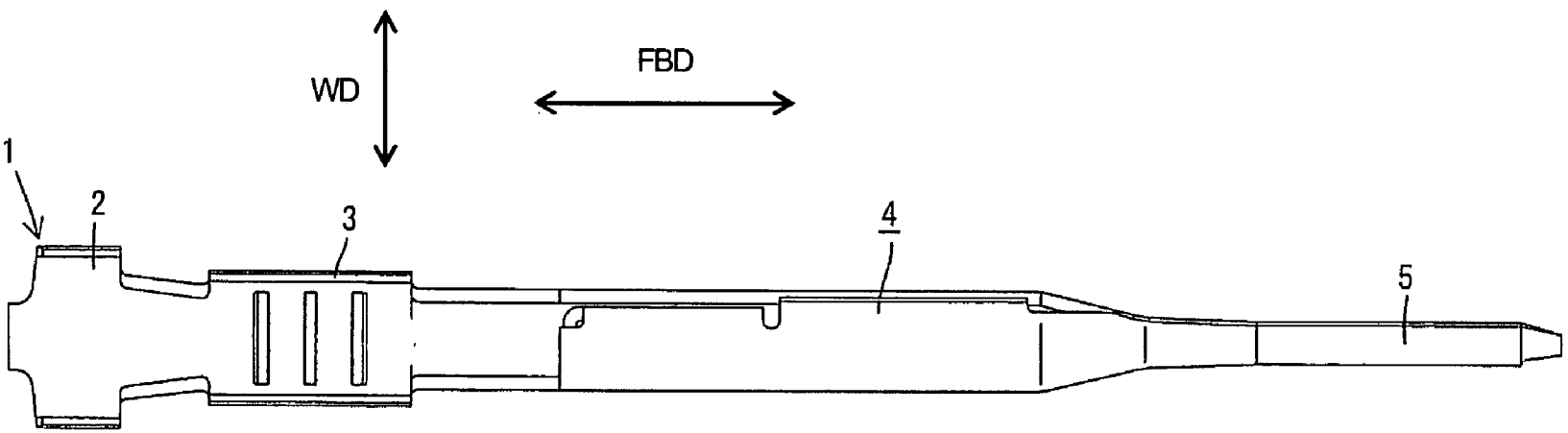
FIG. 7 is a plan view of the male terminal fitting.
Figure 8:
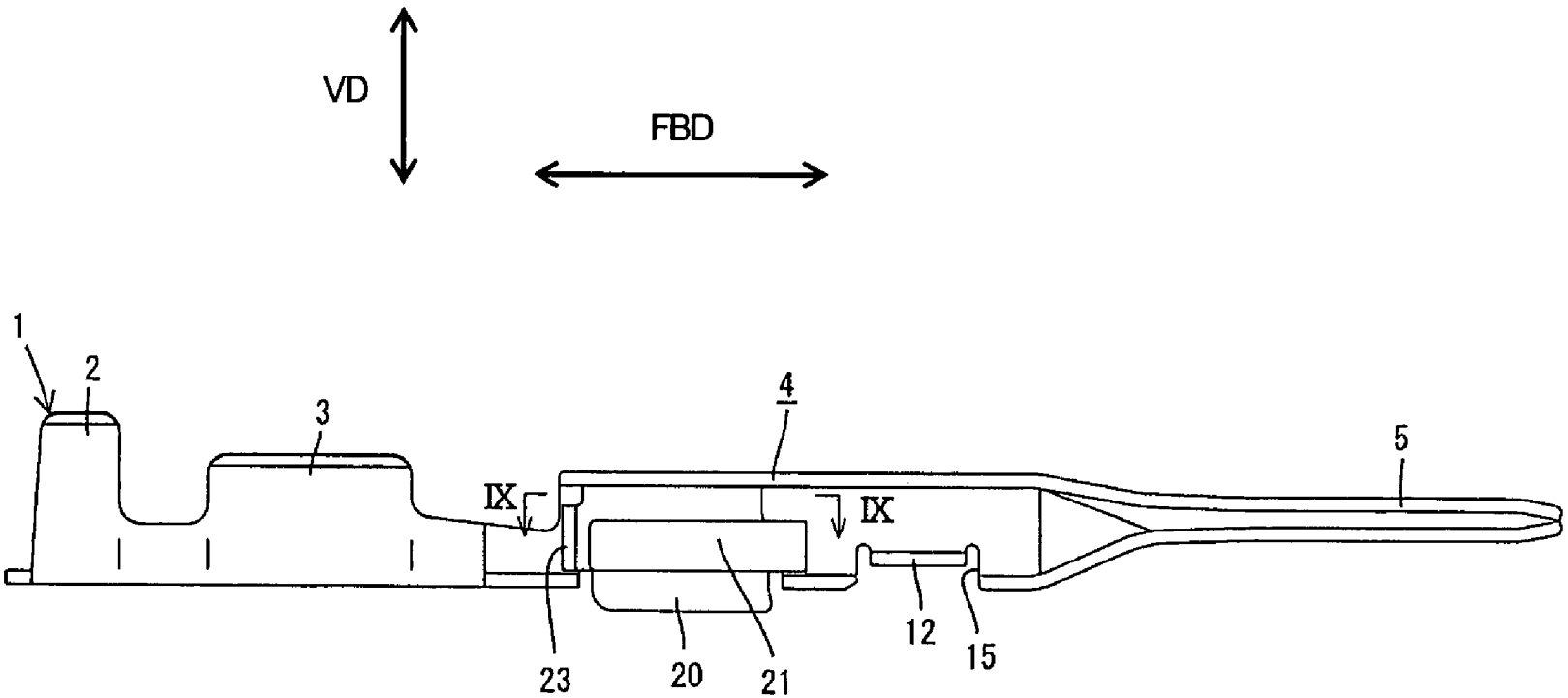
FIG. 8 is a longitudinal section of the male terminal fitting.

As shown in FIG. 3, the rectangular tube 4 is long in forward and backward directions FBD, and bottom plate 6 and first and second side plates 7, 8 bent at right angles from the bottom plate 6 so that the side plates are substantially opposed to each other. A top plate 9 then is bent at a right angle from a top portion of the first side plate 7 to oppose the bottom plate 6. A front part of the rectangular tube 4 is substantially continuous with the terminal contact portion 5 to be connected with a female terminal fitting (not shown) and has a V- or U-shaped cross section that is open sideways.

At least one stabilizer 20 projects down from the bottom of the second side plate 8 (FIG. 3) at a rear part of the rectangular tube 4. The stabilizer 20 prevents the male terminal fitting 1 from being inserted into a cavity of a male connector housing in an improper posture, such as an upside down insertion. More particularly, the male terminal fitting 1 is inserted into the cavity by aligning the stabilizer 20 with a guide groove (not shown) formed in the male connector housing. The stabilizer 20 is formed by making a substantially U-shaped slit from the second side plate 8 to the bottom plate 6 in a development or plane view of the male terminal fitting 1, so that both ends of the U-shaped slits are on a bending edge 27 formed by bending the second side plate 8 from the bottom plate 6. Thus, the stabilizer 20 is formed simultaneously with the bending of the second side plate 8. As a result, the stabilizer 20 is substantially in flush with the second side plate 8 and projects down from the bottom plate 6. The formation of the stabilizer 20 by cutting and bending also forms a cut hole 22 on the bottom wall 6 substantially conforming to the shape of the stabilizer 20. The cut hole 22 is closed by a closely folded portion 21 to prevent or reduce the likeliness of intrusion of external matter or the like from the outside.

Figure 9:
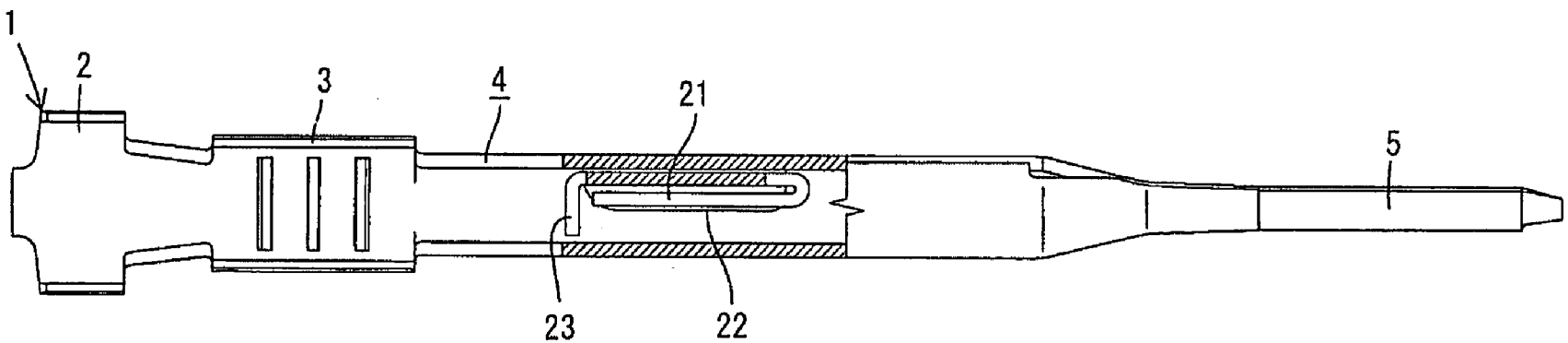
FIG. 9 is a plan view partly in section along IX—IX of FIG. 8.

The closely folded portion 21 is coupled unitarily to a rear part of the top plate 9 by a connecting piece 24 on the blank for forming the male terminal fitting 1, as shown in FIG. 10. The connecting piece 24 extends substantially in forward and backward directions FBD and is at a position along the forward and backward directions FBD of the blank of FIG. 10 substantially opposed to the U-shaped slit that forms the stabilizer 20. Additionally, the length of the connecting piece 24 is approximately the same as the dimension of the U-shaped slit along the forward and backward directions FBD. A covering piece 23 is formed at the rear end of the closely folded portion 21 and projects more backward on the blank than the rear end of the rectangular tube 4. On the other hand, the leading end of the closely folded portion 21 is at substantially the same position as the front end of the rectangular tube 4. A front half of the closely folded portion 21 is bent substantially 180° about a bend line 25, as shown in FIG. 10 into close contact with a surface of the rear half of the closely folded portion, as shown in FIG. 9. The length of this doubled portion along forward and backward directions FBD is substantially equal to a corresponding dimension of the cut hole 22 left by forming the stabilizer 20. The doubled portion is bent by substantially 90° along the longitudinal direction of the connecting piece 24 to extend up from the plane of FIG. 10. Further, the covering piece 23 is bent by substantially 90° along the bending line 26 to extend up from the plane of FIG. 10. As a result, the covering piece 23 is disposed to close an opening at the rear end of the rectangular tube 4. In this way, the closely folded portion 21 is located at the cut hole 22 of the stabilizer 20 substantially in the entire length range of the doubled portion, and substantially entirely closes the cut hole 22.

As shown in FIG. 10, a substantially H-shaped punch hole 11 is formed near the front end of the bottom plate 6, and two closing pieces 12 are substantially opposed to each other in the punch hole 11. The width of the punch hole 11 stretches from the bottom plate 6 to parts of the opposite side plates 7, 8. Both closing pieces 12 are bent substantially 90° along bending lines 13 at their base ends to extend up from the plane of FIG. 10. At this time, the bending lines 13 are at positions more outward than bending lines 27, 28 of the side plates 7, 8 with respect to the width direction WD. As a result, the outer surfaces of the closing pieces 12 are retracted slightly from the outer surface of the bottom plate 6 by a dimension slightly larger than the thickness of the bottom plate 6 in an inward direction ID that is substantially parallel to the vertical direction VD and substantially normal to the forward and backward directions FBD. Thus, the front edge of the punch hole 11 is exposed over substantially the entire width to form a locking edge 15 that is engageable with a lock (not shown) of the male housing. Although the leading ends of the closing pieces 12 are spaced apart by a specified distance in the blank of the male terminal fitting 1, they can be opposed to each other with almost no clearance therebetween to avoid or reduce the likeliness of the intrusion of external matter.

As described above, the punch hole 11 is formed in an area extending from or from close to the bottom plate 6 to the parts of the side plates 7, 8, and the closing pieces 12 are opposed to each other in the punch hole 11. Thus, the locking edge 15 for engaging the lock can be formed without forming an opening, and the intrusion of external matter into the rectangular tube 4 can be prevented. As a result, even if the male terminal fittings 1 are handled in a large numbers, the leading end of the terminal contact portion 5 of one terminal fitting 1 will not intrude into the rectangular tube 4 of another terminal fitting 1 to be deformed. Further, the cut hole 22 left by forming the stabilizer 20 and the opening at the rear end of the rectangular tube 4 are closed by the closely folded portion 21 and the covering piece 23 formed in the rectangular tube portion 4 beforehand. Therefore, neither the terminal contact portion 5 nor external matter can intrude into the rectangular tube 4.

The male terminal fitting 1 illustrated in this embodiment is assumed to be a small-size, and the locking edge 15 needs to be as deep and wide as possible to ensure a sufficient locking force when engaged with the lock. Thus, it is desirable to form the locking edge 15 that extends over substantially the entire width of the side of the rectangular tube 4. However, external matter may intrude through such an opening. Accordingly, consideration might be given to forming one side wall of the rectangular tube as a double-wall structure. Part of the outer wall of this double wall structure could then be removed to form the locking edge 15. However, this possible design is less advantageous than the above-described embodiment because the size of the male terminal fitting would be increased by the thickness of one plate due to the double-wall structure. In this respect, the terminal fitting 1 of the subject invention achieves a sufficient engaging depth with the lock by forming the locking edge 15 that is engageable with the lock over substantially the entire width of the male terminal fitting 1 and freely adjusting the height of the closing pieces 12. Further, the intrusion of external matter can be prevented since no opening is formed at a position of the male terminal fitting 1 to be engaged with the lock.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the locking edge is formed in the bottom plate in the foregoing embodiment, the position thereof is not particularly restricted and the locking edge may be formed in any part of the tube, such as the top plate or the side plate.

Although the male terminal fitting is formed with the locking edge in the foregoing embodiment, the present invention is also applicable to female terminal fittings formed with locking edges.

Although the closing pieces are substantially opposed to each other from the opposite side plates in the foregoing embodiment, one closing piece may extend from one side plate or two closing pieces may extend from substantially opposite side plates.

Although the opening left by forming the stabilizer is at least partly closed by locating the edge of the closely folded portion in the foregoing embodiment, the closely folded portion is not necessary if a plate surface is caused to face the opening. However, if the closely folded portion is arranged substantially in parallel with the rectangular tube and extends in forward and backward directions FBD in the blank of the male terminal fitting as in the foregoing embodiment, efficiency in blank cutout can be improved.

Although the covering piece is formed at the closely folded portion in the foregoing embodiment, it may be formed at the rectangular tube.

Although the above-described tube has a substantially rectangular cross-section, the invention is equally applicable to tubes having other shapes, particularly substantially polygonal (triangular, pentagonal, hexagonal, etc.) shapes.

Although in the above preferred embodiment only one stabilizer is provided in or at the tube, in particular in correspondence to one side, it should be understood that two or more stabilizers may be provided on the same side (longitudinally spaced) and/or on opposite lateral sides (at the substantially same and/or at different longitudinal positions) of the terminal fitting.

Although the above embodiment refers to a male terminal fitting, the invention is equally applicable to a female terminal fitting.

What is claimed is:

1. A terminal fitting insertable into a cavity of a connector housing, and comprising a tube having a base wall and first and second side walls extending unitarily from opposite sides of the base wall, a ceiling wall extending unitarily from the first side wall and supported at least partly on the second side wall so that the ceiling wall is opposed to the base wall, front and rear cuts extending across the base wall and into the first and second side walls, the front cut defining a locking edge in the base wall for engaging a lock in the cavity, and first and second closing pieces formed between the front and rear cuts and extending unitarily from the first and second side walls respectively, the closing pieces extending at an angle in an inward direction towards one another for at least partly closing an opening formed in the tube adjacent to the locking edge.

2. The terminal fitting of claim 1, wherein the front and rear cuts extending substantially along a width direction of the base wall.

3. The terminal fitting of claim 1, wherein an area between the front and rear cuts is retracted inwardly of the tube from the base wall so that the closing pieces are substantially coplanar and parallel to the base wall but spaced inwardly on the tube relative to the base wall.

4. The terminal fitting of claim 1, wherein leading ends of the first and second closing pieces substantially abut against each other.

5. The terminal fitting of claim 1, wherein the first and second closing pieces are substantially equally dimensioned and are opposed to one another at a location substantially equally spaced between the side walls of the terminal fitting.

6. The terminal fitting of claim 1, wherein the base wall a front section forward of the front cut and a rear section rearward of the rear cut, the front and rears sections being substantially coplanar.

7. The terminal fitting of claim 1, wherein the first and second closing pieces are substantially coplanar.

8. The terminal fitting of claim 7, wherein the first and second closing pieces are substantially parallel to the base wall.

* * * * *